US005411105A

United States Patent [19]

Gray

[11] Patent Number: 5,411,105

[45] Date of Patent: May 2, 1995

[54] DRILLING A WELL GAS SUPPLY IN THE DRILLING LIQUID

[75] Inventor: Benjamin Gray, Alberta, Canada

[73] Assignee: Kidco Resources Ltd., Silver Valley

[21] Appl. No.: 260,365

[22] Filed: Jun. 14, 1994

[51] Int. Cl.[6] ..... E21B 43/00

[52] U.S. Cl. ..... 175/69

[58] Field of Search ..... 175/65-71; 166/77

[56] References Cited

U.S. PATENT DOCUMENTS

| | | | |
|---|---|---|---|
| 2,880,963 | 4/1959 | Bobo | 175/69 |
| 3,727,703 | 4/1973 | Hutchison et al. | 175/69 |
| 3,744,579 | 9/1973 | Godfrey | 175/69 X |
| 5,285,850 | 2/1994 | Bayh, III | 166/77 X |

*Primary Examiner*—Michael Powell Buiz
*Attorney, Agent, or Firm*—Adrian D. Battiso; Murray E. Thrift; Stanley G. Ade

[57] ABSTRACT

A conventional well bore drilling system includes a coiled tubing mounted on a reel and connected to a mud supply for supplying mud through the tubing to a downhole end of the tubing to which is attached the downhole drilling tool. The system is modified by the addition of an inner tubing attached to the reel shaft and extending through the outer tubing to the drilling tool. The drilling mud is supplied in the space between the inner and outer tubes and a gas is supplied through the inner tube, The gas is vented through a coupling at the drilling tool into the well bore so as to enter the well bore and reduce the hydrostatic head of the fluids within the well bore to an under balanced condition below the pressure of the producing zone. As the gas is supplied through the inner tube, it is maintained separate from the liquid outside the inner tube and accordingly can be by passed into the well bore without entering the downhole MWD or motor drive systems and in addition the mud pulses generated by the downhole MWD system can be communicated through the drilling mud in conventional manner without losses due to gas within the liquid.

6 Claims, 2 Drawing Sheets

DRILLING A WELL GAS SUPPLY IN THE DRILLING LIQUID

BACKGROUND OF THE INVENTION

This invention relates to a method of drilling a well including supplying gas with the drilling liquid.

The present invention is particularly concerned with under-balanced drilling which is a simple concept in which the hydro static pressure within the well generated by the head of fluid from ground level to the point of drilling is reduced to the point where the formation pressure is higher than the hydro static pressure, allowing the well to flow while drilling. The result of under-balance drilling is a well drilled without formation damage.

While simple in concept, this may be difficult to attain in the practical situation since many reservoirs are pressure depleted and the conventional technique of simply reducing the drilling fluid density to the point where the well starts to flow will not work. In many reservoirs, the reservoir pressure is below the hydrostatic pressure of fresh water which is of course the minimum to which the hydrostatic pressure of the drilling liquid can be reduced without addition of gas.

In such circumstances where the reservoir pressure is below this level, it is necessary, if the well is to be drilled under-balance, to use an alternative technique.

In some cases it is possible to effect drilling using air or other gas as the circulating medium without the conventional drilling liquid. This has a number of disadvantages as follows:

a) The downhole motor life is significantly reduced and is less predictable since the downhole motors are generally designed to be run using the conventional drilling liquid as the power source. The significant differences between drilling liquid or mud and the air or gas have led to problems in the application of these motors to air drilling.

b) Hole cleaning is a problem at inclinations above 50°. Because air is compressible, the flow rate changes with pressure. Also, because of its much lower lifting capacity, air requires annular velocities much greater than that of the conventional drilling liquid. Particularly the air volume required to clean the hole is three times greater than the recommended flow rate for the motor. Such excessive flow rates therefore often cause premature failure of the motor.

c) The air drilling system cannot be used with the conventional MWD (Measurement While Drilling) telemetry system used to communicate downhole information to the surface. Typical MWD equipment pulses the mud system by a downhole pulse generator to vary the pressure within the mud. These variations in pressure are then detected at the surface for the purposes of detecting the coded information transmitted through the mud pulse system from the downhole measuring transducers. Because air is compressible, it cannot be pulsed effectively. Therefore conventional mud pulse (MWD) does not work in an air drilled hole. Other communication systems for example using radio waves are available but are very much less effective.

In the air drilling system, air at high pressure is injected into the drill string and the majority of the air injected is released at an air by-pass sub immediately above the downhole motor. The remaining air passes through the motor, powers the motor and exits through the bit nozzles to effect cleaning.

This system of course generates a very low pressure in the hydrostatic head at the production zone allowing the well to flow during the drilling action so that production materials and the pumped air are communicated to the surface through the annular space between the well and the drill string.

In view of the above difficulties, air drilling has achieved little success. Therefore attempts have been made to reduce the hydrostatic pressure of the drilling liquid by providing nitrogen (or air) injection into the well to supplement the conventional drilling mud and thus reduce the hydrostatic pressure of the mud.

There are two techniques in use. The first technique involves the injection of nitrogen into the drill string so that the drilling liquid and nitrogen are simultaneously pumped into the drill string for communication down the drill string to the drilling tool. This technique has been found to work reasonably well, however there are concerns with motor performance due to the passage of the gas through the motor with the liquid and in addition the MWD mud pulse tools will not work since the gas carried within the liquid is compressible so that the pulses are lost in the elastic material between the downhole mud pulse generator to the transducer at the surface.

The second technique is to inject nitrogen into the annulus of the build section of the well. This requires the installation of a nitrogen injection string while running the intermediate casing and therefore requires more complexity and is not applicable for use while drilling re-entry wells.

It is well known that the MWD system is effective and widely used. The MWD system can be used during motor drilling operations to provide accurate and frequent drift angle and azimuth data. As well, frequent tool face updates are provided while motor drilling. The sensor package, as well the power unit and pulser unit are all part of the drill string.

The inability therefore to use MWD systems has very much limited the use of gas to effect under-balanced drilling and instead many operations have accepted the damage which occurs due to the high hydrostatic pressure forcing the drilling liquid into the producing zone.

SUMMARY OF THE INVENTION

It is one object of the present invention, therefore, to provide an improved method of drilling a well which allows a reduction in the hydrostatic pressure of the liquid within the well by injection of gas.

According to one aspect of the invention there is provided a method of drilling a well comprising providing a drilling tool including a drill bit and a motor for the drill bit, providing a drill string comprising a continuous length of first tubing wound onto a reel, connecting the drilling tool to a downhole end of the drill string, sending the drilling tool and downhole end of the drill string down the well to effect drilling by paying out the tubing from the reel, providing within the tubing a second tubing extending therealong from the reel to a position at or adjacent the drilling tool, supplying liquid through one of the first and second tubings, communicating the drilling liquid through the motor and drill bit for effecting drilling, communicating gas through the other of the first and second tubings separately from the drilling liquid and releasing the gas into the well surrounding the drill string at or adjacent the drilling tool.

Preferably the gas is supplied through the second tubing contained within the first tubing. This arrangement allows the liquid and gas to be applied to the first and second tubings respectively through a swivel system at the reel shaft with the gas being communicated to a second shaft coaxial with and inside the reel shaft.

This arrangement of the present invention maintains a continuous column of the drilling liquid within the first tubing which is entirely separate from the gas within the second tubing so that the pulses generated by the MWD system at the drilling tool can be communicated through this continuous column to transducers at the surface.

The use of continuous tubing for the drill string is a known technique but allows the supply of the gas through the second tubing in a practical and effective manner since both the first and second tubings are continuous from the downhole drilling tool to the reel.

One embodiment of the invention will now be described in conjunction with the accompanying drawings in which:

BRIEF DESCRIPTION OF THE DRAWINGS

in the drawings like characters of reference indicate corresponding parts in the different figures.

DETAILED DESCRIPTION

Figure 1:
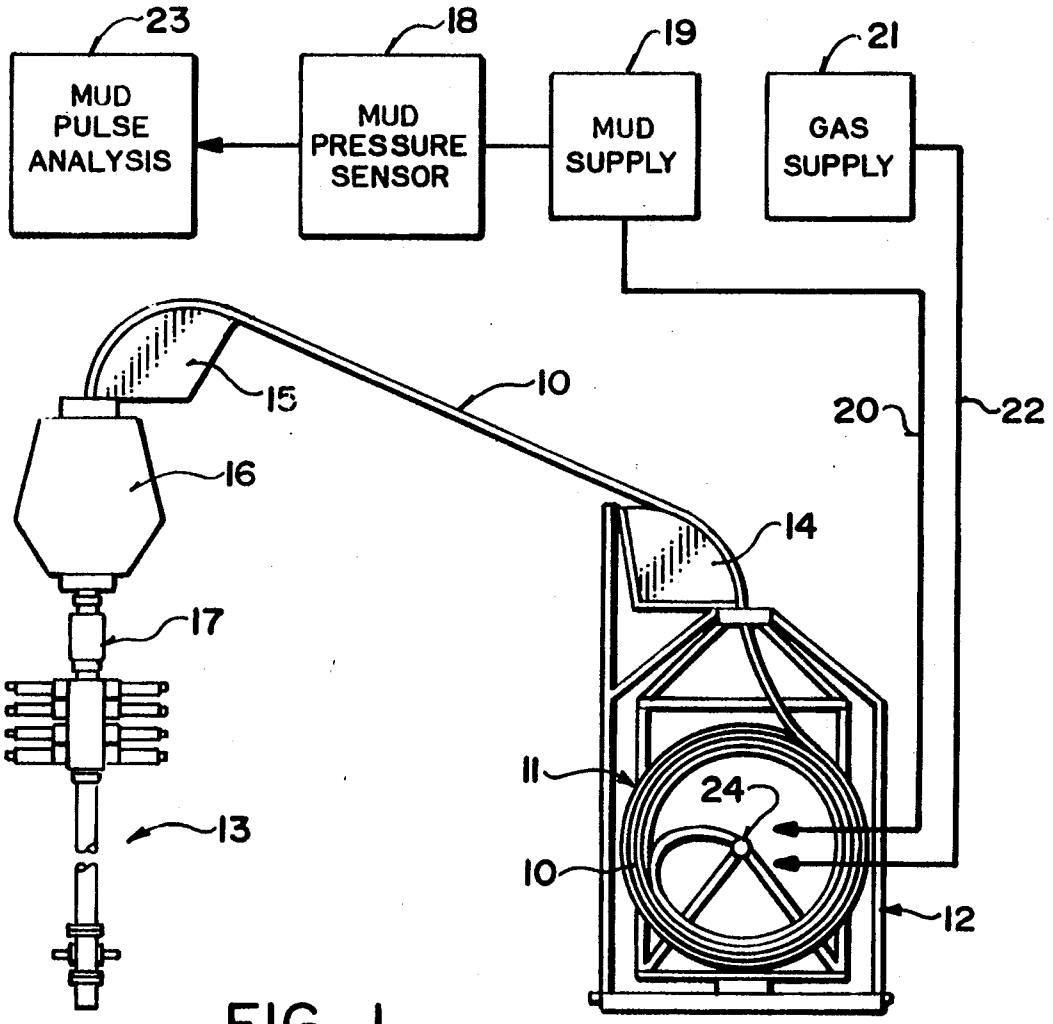
FIG. 1 is a schematic side elevational view of a well head system for drilling a well using coiled tubing.

The construction shown in FIG. 1 is substantially conventional and shows an arrangement for drilling a well using coiled tubing. Thus the coiled tubing is generally indicated at 10 as mounted on a reel 11 on which is wound sufficient length of the tubing to extend from the well head to the producing zone. The reel 11 is mounted on a support frame 12 adjacent the well head generally indicated at 13. The tubing passes over a first arch 14 from the reel to a second arch 15 at the top of the well head. The tubing enters at the bottom of the arch 15 the injector 16 which acts to drive the tubing vertically downwardly or vertically upwardly as required for feeding the tubing into the well or withdrawing the tubing from the well as required. Underneath the injector is provided a stripper 17 which acts to extract returning fluid from the top of the well casing.

A mud supply system 19 is provided for supplying mud into the tubing at the reel 11 through a duct 20. In addition a gas supply system 21 is provided for supplying gas for the reel through a duct 22.

In addition at a suitable location there is provided a mud pressure transducer 18 for detecting pressure pulses within the mud supply transmitted through the tubing. An output from the transducer 18 is supplied to an analyzer system 23 for analysis of signals transmitted through the mud pressure in the conventional MWD system described herein before.

Figure 3:
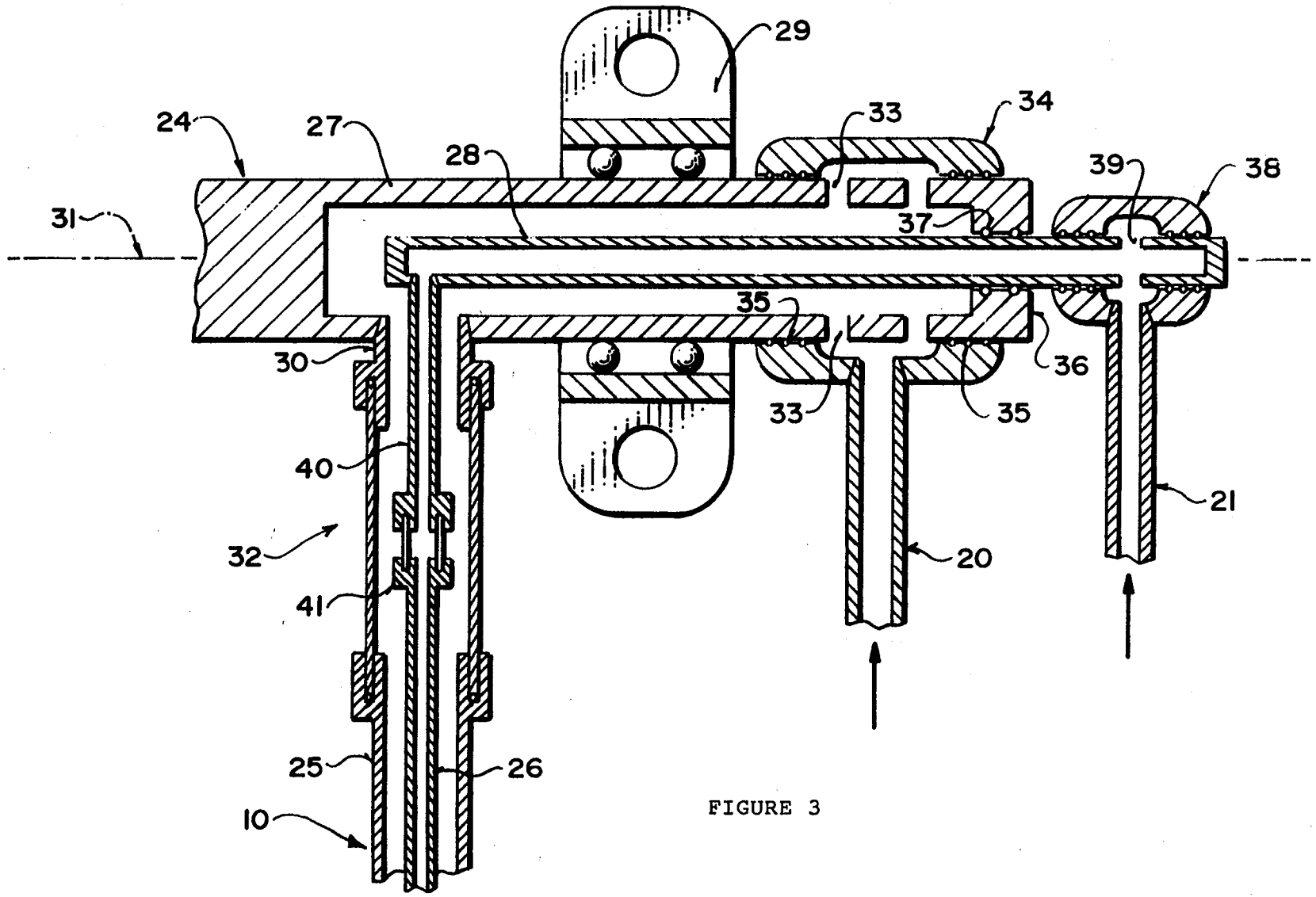
FIG. 3 is a vertical cross sectional view through the horizontal shaft of the reel of FIG. 1.

Turning now to FIG. 3, the construction of the shaft 24 of the reel 11 is shown in more detail, as is the construction of the coil tubing 10 carried on that reel. First the tubing 10 includes an outer tube 25 of conventional construction having a diameter of the order of 2.0 inches. In addition to the outer tubing there is provided an inner tubing 26 which is arranged inside the outer tubing so as to be wholly contained there within. The diameter of the tubing 26 is of the order of 0.75 inches. The tubing 25 is arranged for supply of the conventional drilling mud. The tubing 26 is entirely separate from the material within the tubing 25 and is arranged for containing the gas supply to the well.

In order to communicate the mud from the supply 19 to the tubing 25 and the gas from the supply 21 to the tubing 26, the shaft is modified to include an outer shaft portion 27 at an inner shaft portion 28 coaxial with the outer shaft portion. The outer shaft portion 27 is mounted on a pair of bearings one of which is indicated at 29. The outer shaft portion is hollow and communicates with a pipe portion 30 connected thereto and extending radially from the axis 31 or rotation of the shaft. The pipe portion 31 is connected by a conventional tubing connector generally indicated at 32 to the outer tubing 25.

The outer shaft portion 27 includes a plurality of holes 33 surrounded by a swivel coupling 34 in the form of a sleeve covering the openings 33 with the sleeve connected to the supply pipe 20 for transmission of the drilling mud from the pipe 20 through the openings 33 into the hollow interior of the shaft portion 27. The sleeve 34 includes seals 35 surrounding the shaft portion 27 and spaced on either side of the openings 33.

The inner shaft portion 28 passes through an end plate 36 of the outer shaft portion with seals 37 between the end plate 36 and the outer surface of the shaft portion 28 preventing the escape of the mud from the hollow interior of the shaft portion 27. The inner shaft portion 28 extends beyond the end plate 36 and carries a further swivel coupling 38 connected to the gas supply pipe 22. Gas from the supply pipe 22 thus passes into the interior of the swivel sleeve 38 and enters openings 39 in the inner shaft portion to pass along the inner shaft portion to a radially extending pipe portion 40 arranged inside the pipe portion 30. The pipe portion 40 extends beyond the end of the pipe portion 30 and receives a conventional tubing connector 41 for connection to the tubing 26.

In this way the drilling mud is supplied into the space between the outer tubing 25 and the inner tubing 26 to be communicated therealong to the downhole drilling tool. Entirely separately from the drilling mud is supplied the gas from the supply 21 through the supply pipe 22 into the interior of the tubing 26 for transmission through the tubing to the downhole drilling tool.

Figure 2:
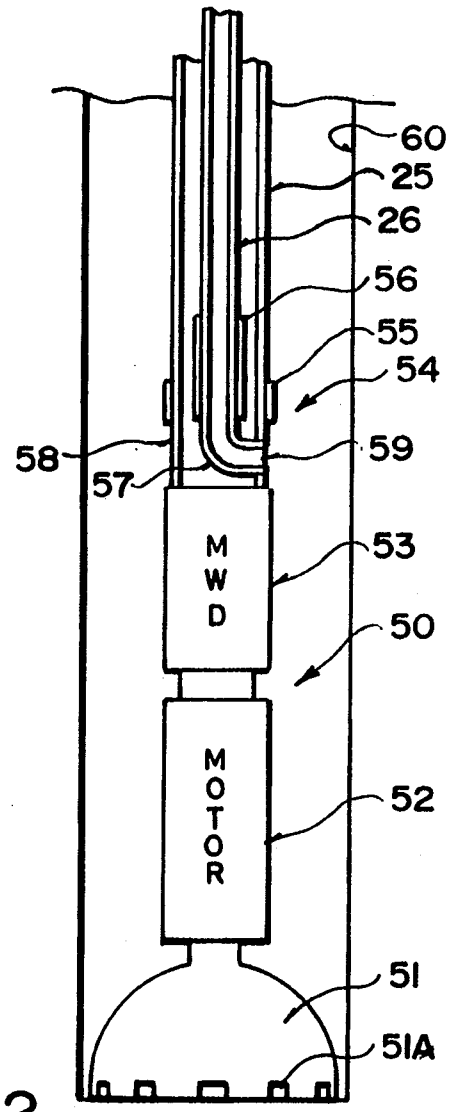
FIG. 2 is a schematic vertical cross sectional view through the downhole drilling tool.

Turning now to FIG. 2, the downhole drilling tool is shown schematically and indicated at 50. This includes a conventional drill bit 51 and a conventional downhole drive motor 52 which is driven by the supply of drilling mud through the motor. The mud after passing through the motor is transmitted through the drill bit 51 and emerges through openings 52 in the drill bit to sweep away drill cuttings.

Also as part of the drilling tool is provided the conventional MWD system 53 which includes various downhole transducers for measuring various parameters of the drilling system as is well known to one skilled in the art. The MWD system further includes a power pak for supplying power to the transducers and also a downhole mud pulse telemetry system for generating pulses in the drilling mud. Various techniques are available for generating such pulses. These pulses are backed up through the incompressible drilling mud in the space between the inner tubing 26 and the outer tubing 25 to the sensor 18 at the surface. The presence of the gas within the inner tubing 26 does not in any way interfere with the transmission of the mud pulses since the gases contain separately and is not in any way compressed by those mud pulses.

The inner tubing 26 and the outer tubing 25 are connected to the downhole drilling tool 50 by a coupling element 54. The coupling element includes tubing connectors 55 and 56 similar to those indicated at 32 and 41. The coupling 54 further includes a discharge nozzle 57 which is connected to the inner tubing 26 by the coupling 56 and then turns right angles to a wall 58 of the connector 54 to discharge the gas through an opening 59 in the wall 58 of the coupling. The gas is thus discharged into the well bore 60 at a position at or adjacent the downhole drilling tool so that the gas enters the well bore 60 and passes upwardly through the well bore with the mud and materials generated from the producing zone. All of these materials pass upwardly through the well bore 60 to the stripper 17 for separation in conventional manner. The presence of the gas injected into the well bore reduces the hydrostatic pressure of the materials within the well bore. The volume of the gas injected through the opening 59 is controlled by the pressure of the gas from the supply 21 and this pressure is controlled in dependence upon the required hydrostatic head to ensure that the hydrostatic head is maintained below the pressure in the producing zone to maintain the well bore in an under-balance condition.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A method of drilling a well comprising providing a drilling tool including a drill bit and a motor for the drill bit, providing a drill string comprising a continuous length of first tubing wound onto a reel, connecting the drilling tool to a downhole end of the drill string, sending the drilling tool and downhole end of the drill string down the well to effect drilling by paying out the first tubing from the reel, providing within the first tubing a second tubing extending therealong from the reel to a position at or adjacent the drilling tool, supplying liquid through one of the first and second tubings, communicating the drilling liquid through the motor and drill bit for effecting drilling, communicating gas through the other of the first and second tubings separately from the drilling liquid and releasing the gas into the well surrounding the drill string at or adjacent the drilling tool.

2. The method according to claim 1 wherein the drilling liquid is communicated through the first tubing and wherein the gas is communicated through the second tubing within the first tubing.

3. The method according to claim 1 wherein the gas is released into the well at a position above the drilling tool.

4. The method according to claim 1 including providing on the reel a reel shaft for rotation about a reel axis, supplying the drilling liquid through a swivel coupling into a hollow interior of the reel shaft, connecting the first tubing to the reel shaft for rotation therewith, providing a second shaft coaxial with the reel shaft and within the hollow interior thereof and communicating the gas to the second shaft through a swivel coupling on the second shaft and mounted beyond an end of the reel shaft, the second shaft being connected to the second tubing so as to pass through the coupling between the reel shaft and the first tubing.

5. The method according to claim 1 including sensing pressure within the drilling liquid in the first tubing with the pressure in the drilling liquid being maintained separate from the pressure in the gas so as to detect pulses within the drilling liquid supplied from a downhole measurement system.

6. The method according to claim 1 wherein the pressure and volume of gas supplied into the well is sufficient to maintain pressure in the producing region of the well greater than the head of liquid and gas standing in the well.

* * * * *